US007614574B2

(12) United States Patent
Jakobi et al.

(10) Patent No.: US 7,614,574 B2
(45) Date of Patent: Nov. 10, 2009

(54) CUTTER HEAD FOR A MEAT CUTTER

(75) Inventors: Norbert Jakobi, Biedenkopf-Wallau (DE); Jurgen Bernhardt, Biedenkopf-Wallau (DE)

(73) Assignee: CFS Germany GmbH, Biedenkopf-Wallau (DE)

( * ) Notice: Subject to any disclaimer, the term of this patent is extended or adjusted under 35 U.S.C. 154(b) by 134 days.

(21) Appl. No.: 10/552,514

(22) PCT Filed: Mar. 31, 2004

(86) PCT No.: PCT/EP2004/003413

§ 371 (c)(1),
(2), (4) Date: Aug. 14, 2006

(87) PCT Pub. No.: WO2004/089583

PCT Pub. Date: Oct. 21, 2004

(65) Prior Publication Data

US 2007/0180968 A1 Aug. 9, 2007

(30) Foreign Application Priority Data

Apr. 8, 2003 (DE) ..... 103 16 303

(51) Int. Cl.
*B02C 18/16* (2006.01)

(52) U.S. Cl. ..... 241/292.1; 241/199.12

(58) Field of Classification Search ..... 241/82.1–82.5, 241/292, 292.1, 199.12
See application file for complete search history.

(56) References Cited

U.S. PATENT DOCUMENTS

| | | | | |
|---|---|---|---|---|
| 3,491,818 | A | 1/1970 | Schaller | 146/96 |
| 4,258,593 | A | 3/1981 | Oinonen | 76/101 A |
| 4,732,337 | A | 3/1988 | Knecht | |
| 5,093,151 | A | 3/1992 | van den Berg et al. | 427/39 |
| 5,246,787 | A | 9/1993 | Schulz et al. | 428/629 |
| 6,386,469 | B1 | 5/2002 | Meister et al. | 241/294 |
| 6,427,572 | B2 | 8/2002 | Ciani et al. | 83/676 |
| 2007/0028742 | A1 | 2/2007 | Muller et al. | |
| 2008/0047407 | A1 | 2/2008 | Muller et al. | |

FOREIGN PATENT DOCUMENTS

| | | | |
|---|---|---|---|
| DE | 304 079 | C | 3/1914 |
| DE | 23 06 822 | A | 8/1974 |
| DE | 2306822 | A | 8/1974 |
| DE | 31 39 871 | | 4/1983 |
| DE | 3139871 | | 4/1983 |
| DE | 34 12 743 | C1 | 10/1985 |
| DE | 3412743 | C1 | 10/1985 |
| DE | 36 17 349 | A1 | 11/1987 |
| DE | 3617349 | A1 | 11/1987 |
| DE | 4037122 | * | 5/1992 |

(Continued)

OTHER PUBLICATIONS

German Search Report, Application No. 10316303.4, dated Mar. 16, 2004.

(Continued)

*Primary Examiner*—Mark Rosenbaum
(74) *Attorney, Agent, or Firm*—Dobrusin & Thennisch PC

(57) ABSTRACT

The invention relates to a cutter head disk for a meat cutter, on which at least one knife can be mounted by means of eccentric bolts and optional magnets and which is provided with a metallic core for accommodating the drive shaft. Preferably, the core comprises a plastic envelope. The invention further relates to a knife having a geometry that is provided with a great axial load-bearing capability. Also disclosed are a system comprising a cutter head disk and two knives, a cutter head encompassing several systems, and a method for assembling a cutter head.

21 Claims, 10 Drawing Sheets

FOREIGN PATENT DOCUMENTS

| | | | |
|---|---|---|---|
| DE | 44 29 046 | A | 2/1996 |
| DE | 4429046 | A | 2/1996 |
| DE | 39 35 320 | C2 | 4/1996 |
| DE | 3935320 | C2 | 4/1996 |
| DE | 196 06 188 | C2 | 10/1998 |
| DE | 19606188 | C2 | 10/1998 |
| DE | 198 26 652 | A | 8/1999 |
| DE | 19826652 | A | 8/1999 |

OTHER PUBLICATIONS

International Search Report PCT/EP2004/003413, dated Oct. 21, 2004, published as WO2004/089583A3.

International Search Report on Patentability, Dated Apr. 6, 2005, Application No. PCT/EP2004/003413.

Co-Pending U.S. Appl. No. 10/565,871, filed Jul. 23, 2004, Published as 2007/0028742.

Co-Pending U.S. Appl. No. 11/836,329, filed Aug. 9, 2007, Published as 2008/0047407.

* cited by examiner

CUTTER HEAD FOR A MEAT CUTTER

This application is the National Stage of International Application No. PCT/EP2004/003413, International Filing Date, Mar. 31, 2004, which designated the United States of America, and which international application was published under PCT Article 21(2) as WO Publication No. WO 2004/089583 A3 and which claims priority from German Application No. 103 16 303.4, filed Apr. 8, 2003.

The present invention relates to a cutter head disk for a meat cutter, on which at least one knife can be mounted and which has a preferably metallic core for accommodating the drive shaft. The present invention furthermore relates to a system comprising a cutter head disk and two knives and a cutter head comprising a plurality of systems and a method for installation of a cutter head.

Cutter heads of the generic type are known from the prior art. For example, the publication U.S. Pat. No. 3,491,818 discloses a knife for a meat-cutting machine with a cutter head which is arranged on a shaft having a conical stem. A bushing with an annular rosette is arranged on the stem. The cutting edges are arranged on the bushing alternating with locking adjusting disks, the adjusting disks bringing about an identical axial distance of the cutting edges from one another. In order to adjust the cutting edges, use is made of micrometer adjusting screws. The cutter head is fastened to the conical stem by means of a nut.

However, these cutter heads have the disadvantage that they can be fitter only with comparative complexity because the cutter head disks can generally only be fitted on the cutter shaft together with the knives. Furthermore, the cutter heads are comparatively unhygienic because the material to be cut can collect within the cutter head disk and between the cutter head disk and the knives fitted on it.

The publication D2 (DE 304 079 C) discloses a machine for cutting meat in which two groups of knives are arranged perpendicularly with respect to each other in such a manner that the cutting material is grasped by both groups of knives. The groups of knives can be removed as a whole from the machine in order to clean them.

The present invention is therefore based on the object of providing a cutter head disk for a meat cutter which does not have the disadvantages of the prior art.

The object is achieved by a cutter head disk for a meat cutter, on which at least one knife can be mounted and which has a preferably metallic core for accommodating the drive shaft and in which the core is surrounded, preferably encapsulated by casting, by an envelope.

The envelope is preferably composed of plastic. This embodiment of the present invention has the advantage that the cutter head disk has a comparatively low weight, which is a positive attribute during transportation, during installation and at high rotational speeds. Furthermore, plastic envelopes are comparatively elastic, with the result that the cutter head disks and the associated knives can readily be fixed against one another and in a sealing manner.

"Surrounds" within the meaning of the invention signifies a frictional and/or interlocking bond between the core and the envelope, with the result that cut material cannot pass between the core and the envelope.

The core preferably has recesses in which in each case at least one eccentric retaining bolt for the knife can be mounted.

The object is furthermore achieved by a cutter head disk for a meat cutter, on which at least one knife can be mounted and which has recesses in which in each case one eccentric retaining bolt for the knife can be mounted. The eccentric retaining bolts are preferably preassembled on the cutter head disk before the cutter head disk is fitted on the cutter head shaft.

The following details apply to all of the subject matters of the present invention.

The cutter head disk preferably has magnets at which the knives can be fixed to the cutter head disk.

In a further preferred embodiment, the cutter head disk according to the invention has a sealing edge, preferably on both sides of the disk. This sealing edge is preferably designed as a raised circular ring.

The cutter head disk according to the invention furthermore preferably has recesses into which, for example, weights for counterbalancing the disk together with knives can be fitted.

In a further preferred embodiment, the cutter head disk has shoulders between which the base of the knife can be mounted. The height of the shoulders is preferably essentially the same as or somewhat smaller than the thickness of the base of the knife and the distance between the shoulders particularly preferably corresponds essentially to the width of the base of the knife.

The cutter head disk according to the invention has the advantage that no cutting material can penetrate between the preferably metallic core and the plastic envelope. Furthermore, no cutting material penetrates through the sealing edge between the cutter head disk and the knives fitted thereon, which likewise constitutes a considerable hygienic advantage. The cutter head disk according to the invention can initially be fitted on the cutter head shaft without knives. Only then are the knives fitted on the cutter head disk and held on the cutter head disk by the magnets before the cutter head disk together with knives is fixed on the shaft, for example with a clamping nut, which constitutes a considerable facilitation of installation. The transportation of cutter disk together with knives is considerably simplified with the cutter head disk according to the invention because the knives and the cutter head disk are easy to remove and accordingly can be transported separately from one another.

The cutter head disk according to the invention can be produced in a simple and cost-effective manner.

The present invention furthermore relates to a knife in which the ratio of clamping radius B to knife radius A is 0.3 to 0.4, preferably 0.37 to 0.38. Furthermore, a knife is claimed in which the ratio of knife radius A to receiving width C is 1.4 to 2.0, preferably 1.6 to 1.7. This knife preferably has the ratio according to the invention of B to A. This preferred embodiment of the system according to the invention has the advantage that the knives withstand relatively high axial loads.

The present invention furthermore relates to a system comprising a cutter head disk and two knives which in each case have two recesses, preferably holes, with the eccentric bolts being introduced into the hole.

A further aspect of the present invention is a system comprising the cutter head disk according to the invention, a knife and a filling plate, the knife and the filling plate in each case having two recesses, preferably holes, through which eccentric bolts are introduced.

The filling plate is preferably preassembled on the cutter head disk before the cutter head disk is fitted on the cutter head shaft.

In a preferred embodiment of the system according to the invention, the filling plate has recesses through which the dynamic unbalance can be compensated for.

In a further preferred embodiment of the system according to the invention, the knives and/or the filling plate are to be reversibly fastened to the cutter head disk with the magnets. This embodiment of the present invention has the advantage that the cutter head disk can be mounted on the cutter head shaft without the knives and the knives can then be fitted by the recesses of the knives being guided over the eccentric bolts and a releasable frictional connection between the metallic knife and the magnets being formed.

The cutter head disk and the knives fitted thereon are preferably designed in such a manner that the ratio of clamping radius B to knife radius A is 0.3 to 0.4, preferably 0.37 to 0.38. Furthermore, the ratio of knife radius A to receiving width C is preferably 1.4 to 2.0, with preference 1.6 to 1.7. This preferred embodiment of the system according to the invention has the advantage that the knives withstand relatively high axial loads and the cutter head disk is not of such a large design that the volumetric flow of the cut material is obstructed.

The system according to the invention has the advantage that no cutting material can penetrate between the metallic core and the envelope. Furthermore, no cutting material penetrates through the sealing edge between the cutter head disk and the knives fitted thereon, which likewise constitutes a considerable hygienic advantage.

The present invention furthermore relates to a cutter head which has a plurality of systems according to the invention. These systems are arranged one behind another on a cutter head shaft and are fixed on the cutter head shaft by a clamping nut.

The cutter head according to the invention is suitable in particular for a very high rotational speed of the knife tip, preferably >approx. 145 m/sec. The dynamic unbalance is compensated for in the region of the cutter head disks; i.e. in the knife plane. All of the knives of the cutter head are identical in length and can accordingly be arranged on any desired cutter head disk within the cutter head. The knives do not have to be assigned to a certain meat cutter, which considerably simplifies the logistics of the knives. A malfunction of the cutter head due to defective balancing is avoided. The cutter head according to the invention is fully self-contained, so that no cut material can accumulate between the individual cutter head disks. The cleaning of the cutter head according to the invention can take place after release of the clamping nut without using a tool. A static or dynamic balancing of the cutter head according to the invention generally does not take place.

The present invention furthermore relates to a method for installing a cutter head according to the invention, in which the cutter head disk is fastened to the shaft and the knives and/or a knife and a filling plate are then mounted on the cutter head disk.

The cutter head is preferably then fixed on the shaft by a clamping screw.

Furthermore, the cutter head disks and the knives and filling plates can be preassembled on a sleeve which is then mounted on the cutter head shaft.

The method according to the invention can be carried out very simply and in a very cost-saving and harmless manner for the installer, since first of all the cutter head disk can be fitted on the cutter head shaft and then the knives can be fitted to the cutter head disk. The next cutter head disk is then installed. After all of the cutter head disks and knives are installed, these have merely to be fixed on the cutter head shaft preferably by a clamping nut. For removal, first of all the knives are removed from a cutter head disk and then this cutter head disk is removed from the shaft. Every knife can be combined with every cutter head disk, which considerably simplifies the installation and the logistics of the knives. The same knife may even be used in different meat cutters.

The invention is explained below with reference to FIGS. 1 to 10. These explanations are merely by way of example and do not restrict the general concept of the invention.

Figure 1:
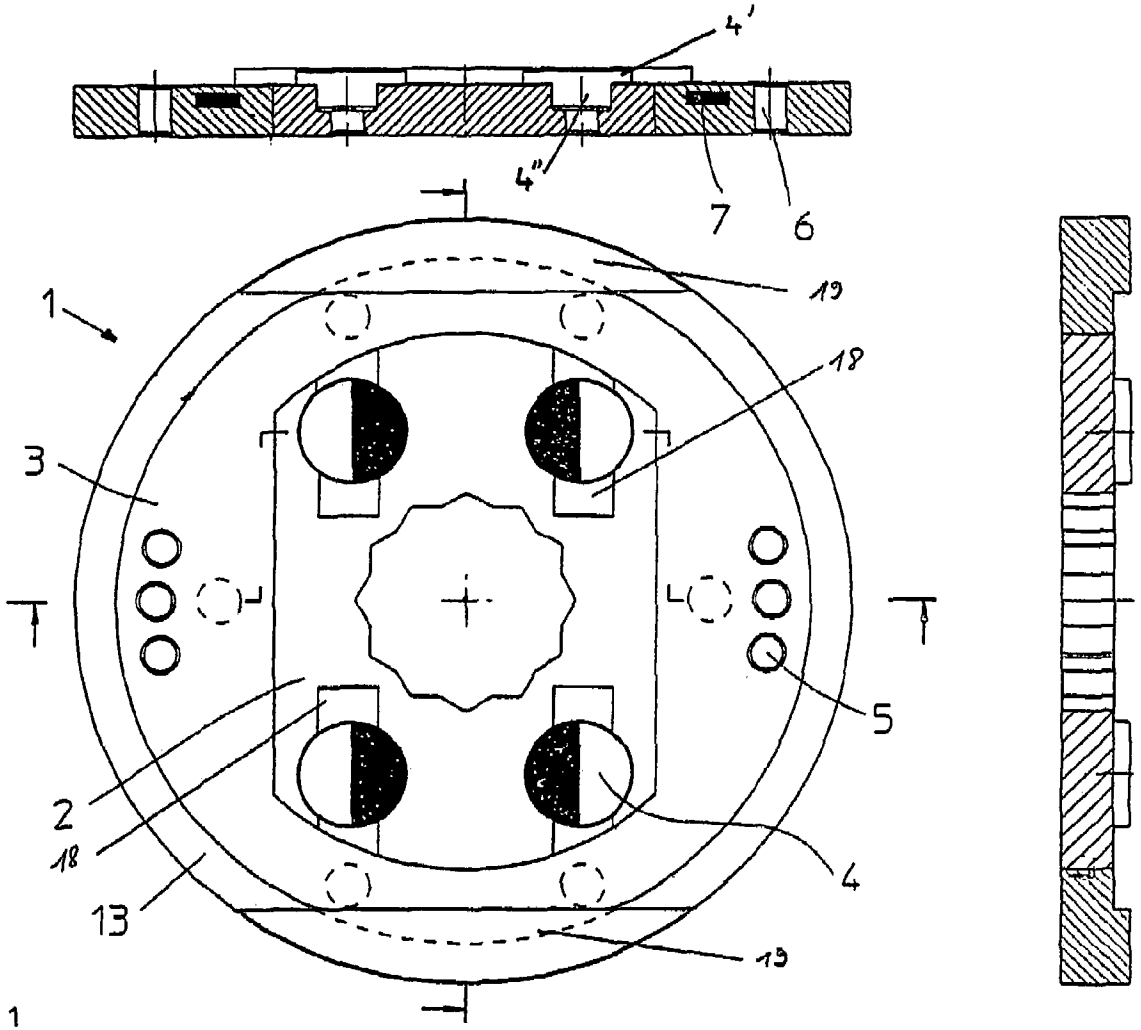
FIG. 1 shows an embodiment of the cutter head disk according to the invention.

FIG. 1 shows an embodiment of the cutter head disk 1 according to the invention which comprises a metallic core 2 and a plastic envelope 3. According to the invention, the core 2 is encapsulated with the plastic envelope 3 by casting, so that there is an interlocking and/or frictional bond between the two parts without further aids and material cannot collect between the metallic core and the plastic envelope. The outside of the metallic core preferably has means, for example a ribbing, which improves the bond between the core 2 and the plastic envelope. A preferably 12-edged receptacle for the drive shaft of the cutter head is arranged in the metallic core. Also provided in the metallic core are recesses 18 which can in each case accommodate an eccentric retaining bolt with which the knives (not illustrated) can be mounted on the cutter head disk. In the present case, the eccentric retaining bolts 4 are inserted into the recesses 18. The eccentric retaining bolts 4 have a circular, disk-shaped head 4' which is arranged eccentrically on its base 4", where the areas shown in black protrude further out of the center than the areas shown in white. This eccentricity permits the knife (not illustrated) to be arranged in two different positions on the cutter head disk by means of a bolt. A cutter head disk is supplied as a set with a plurality of eccentric retaining bolts which differ, however, only in the degree of their eccentricity. The head 4' and the base 4" are in each case identical. The person skilled in the art recognizes that the eccentric bolts may also have different shapes. For example, eccentric bolts with more than two adjustments are conceivable, in which case the cutter head disk here must not have any shoulders.

Figure 3:
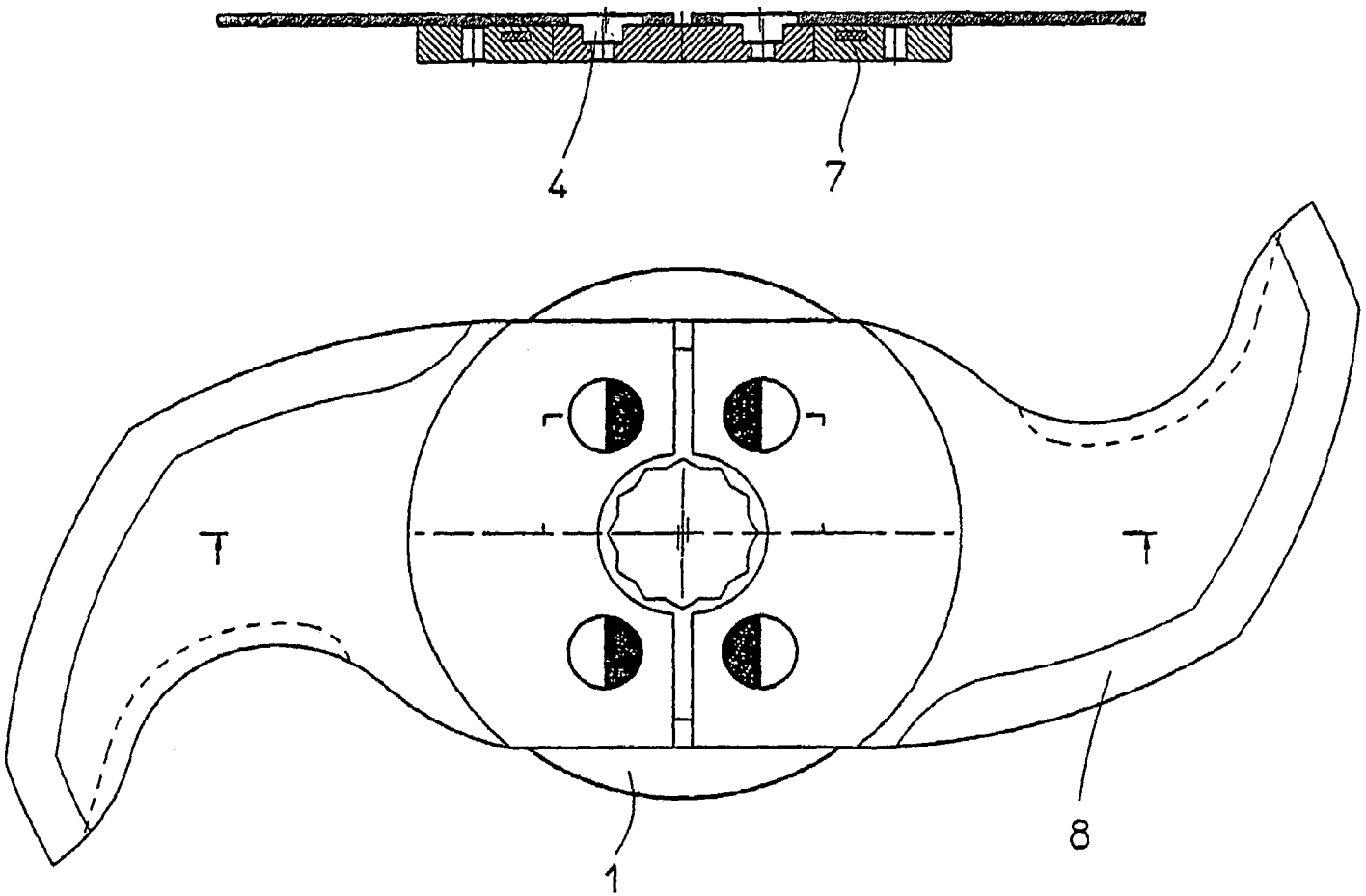
FIG. 3 shows the system according to the invention with one position of the eccentric retaining bolts.
Figure 4:
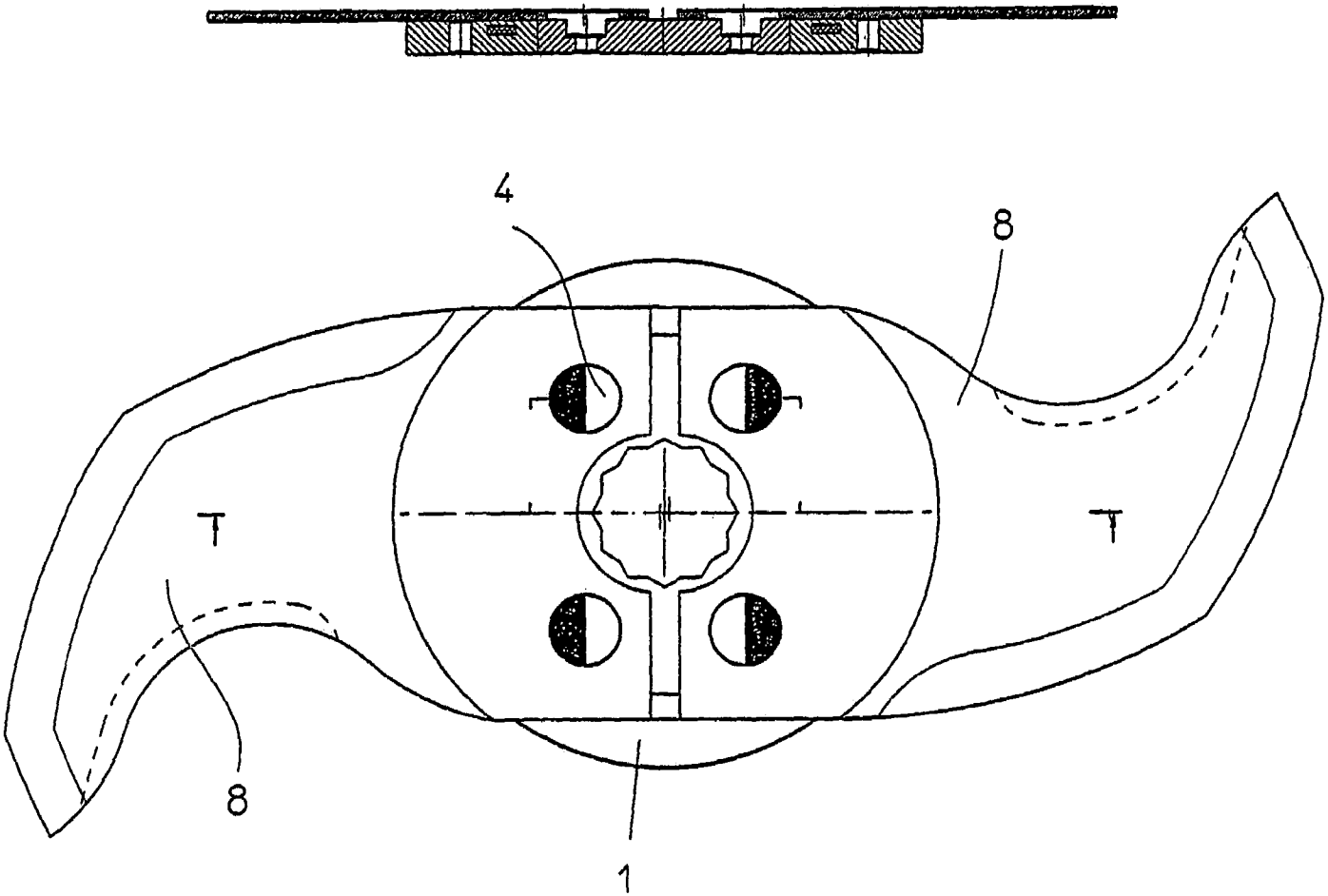
FIG. 4 shows the system according to the invention with a different position of the eccentric retaining bolts.

Permanent magnets 7 with which the knives can be fixed on the cutter head disk are embedded in the plastic envelope 3, which can be seen, for example, in FIG. 3 or 4. Furthermore, the plastic envelope has recesses 5 into which, for example, weights can be inserted in order to be able to compensate for unbalances, for example differences in weight of knives. The sealing edge 13 interacts with the knives (not illustrated) fitted on it and has the effect that no cut material passes between the knife and the cutter head disk. The person skilled in the art recognizes that a sealing edge of this type can also be arranged on the other side of the cutter head disk. Furthermore, the cutter head disk according to the invention has shoulders 19 between which the base of the knife is arranged. The height of the shoulders and the thickness of the base of the knife should as far as possible be the same or differ merely by the particular degree of tolerance. The distance between the shoulders corresponds essentially to the width of the base of the knife.

Figure 2:
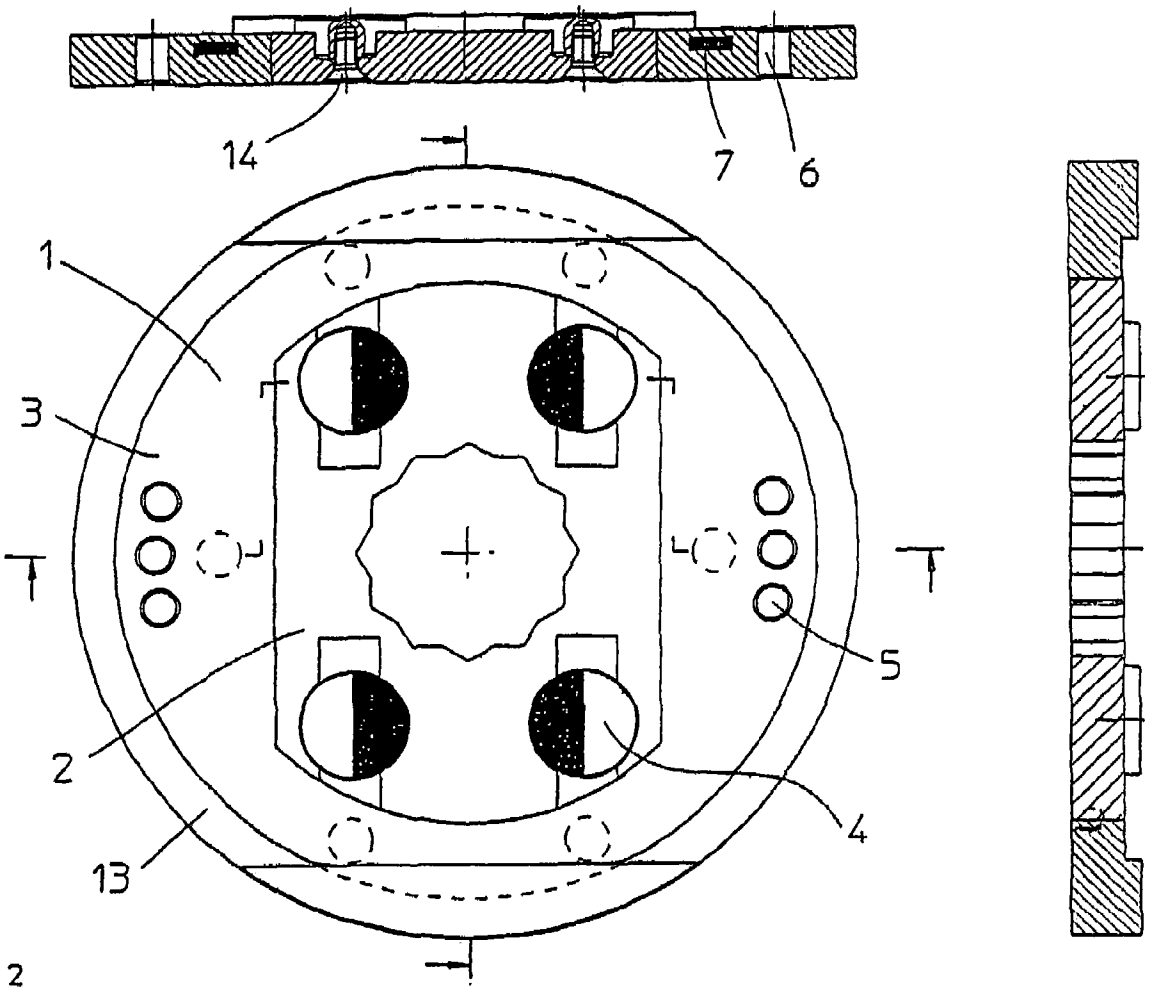
FIG. 2 shows a further embodiment of the cutter head disk according to the invention.

In FIG. 2, essentially, the cutter head disk according to FIG. 1 is illustrated, but in the present case the eccentric retaining bolts 4 are not inserted into the recesses 18, but are fastened by means of screws 14. The person skilled in the art recognizes that further fastenings are conceivable.

FIG. 3 shows the system according to the invention comprising a cutter head disk 1 and two knives 8. The eccentric retaining bolts are positioned inward with their wide side, which is illustrated in black, so that the radial extent of the system is as small as possible. This is the typical position of the eccentric retaining bolts 4 with knives 8, the outer radius of which has not yet been reduced by being worn down.

FIG. 4 shows a system according to the invention, in which the eccentric retaining bolts are arranged on the cutter head disk in such a manner that their wide sides (illustrated in black) are directed outward, so that in the present case the radial extent of the knife is as large as possible. This position is selected, for example, if, after grinding, the radial extent of the knife has been reduced to such an extent that the distance between cutter edge and the bowl of the cutter in which the knife rotates has become too large, although occurs only when the knife is damaged. The person skilled in the art recognizes that a system is supplied with a plurality of eccentric retaining bolts which differ merely with regard to their degree of eccentricity, so that the radial extent of the system can be set with very great precision. It is possible, for example, to position all of the knives at a defined distance from the bowl.

Figure 5:
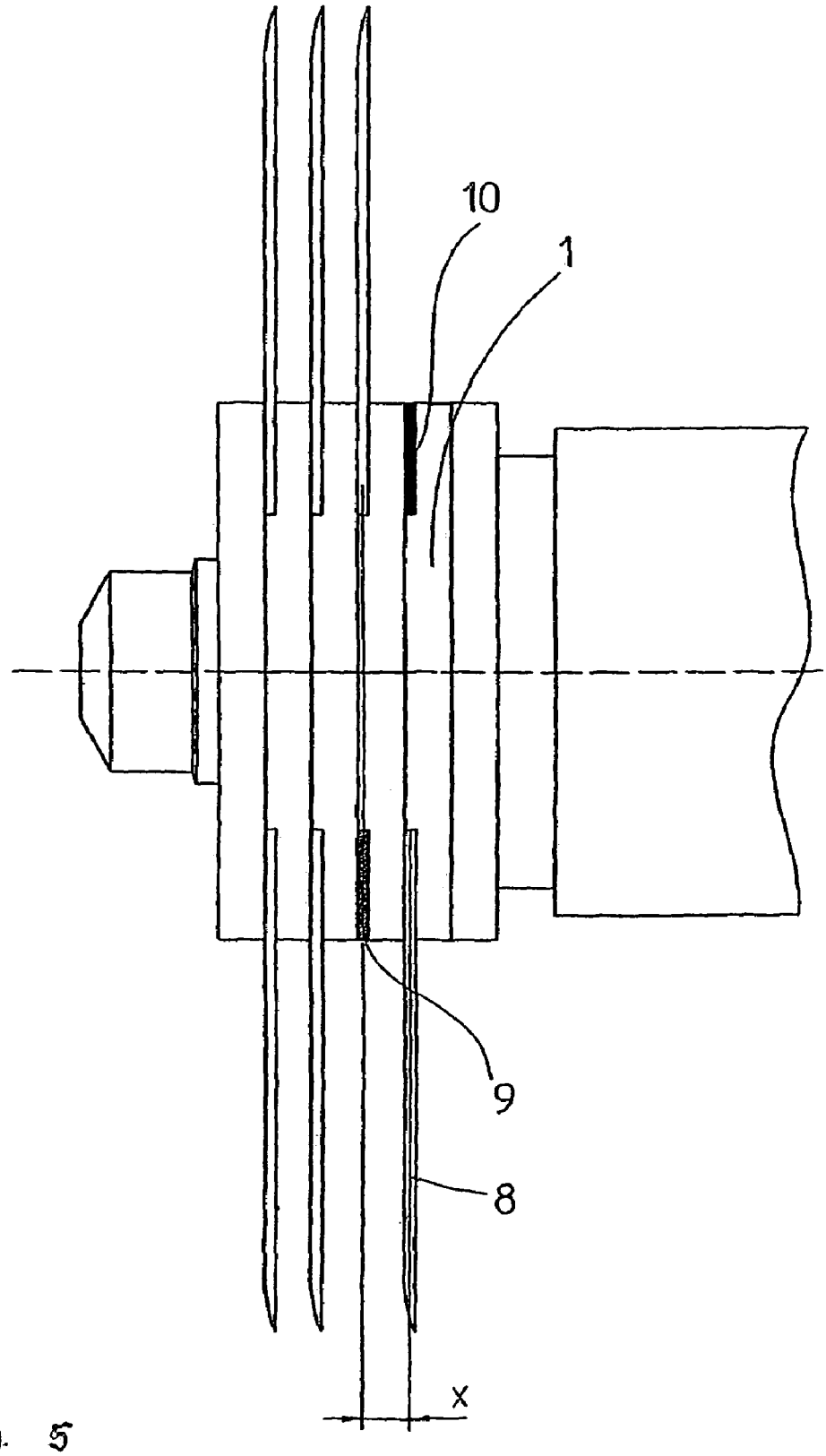
FIG. 5 shows the cutter head according to the invention.

FIG. 5 shows a variant of the cutter head according to the invention which, in the present case, comprises four cutter head disks according to the invention, of which two are fitted in each case with two knives 8 on a running plane and two are fitted in each case with a knife and a filling plate 9, 10 on different running planes. The knives together with cutter head disk are fixed on the drive shaft of the cutter head by means of a clamping nut. Details of the filling plates 9, 10 can be gathered from FIGS. 6, 7. The knives 8 may be arranged on any desired running planes.

Figure 6:
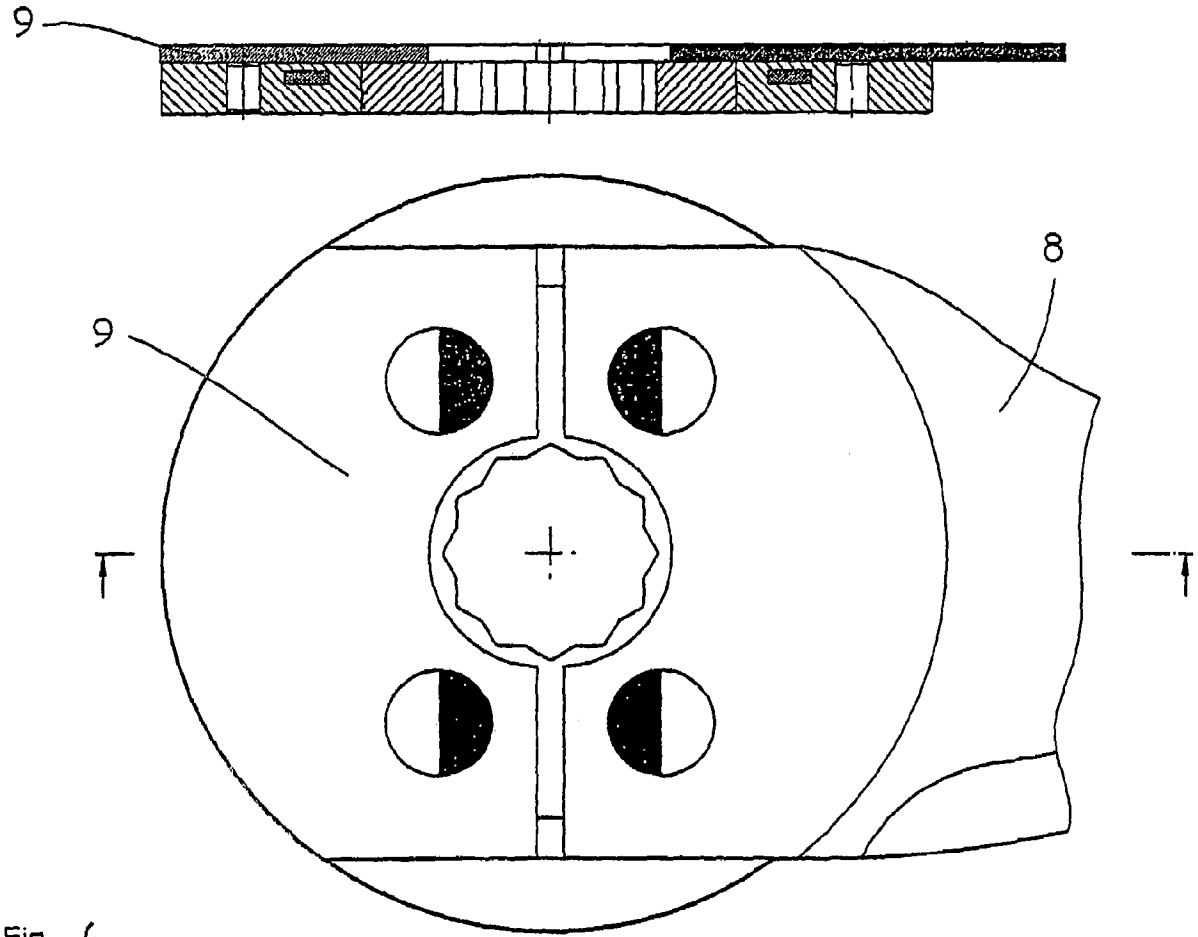
FIG. 6 shows the system according to the invention with a filling plate.

FIG. 6 shows a system according to the invention with a filling plate which is preassembled on the cutter head disk before the latter is mounted on the cutter head shaft. In the same manner as the knife 8, the filling plate 9 has recesses with which they are placed onto the eccentric retaining bolts. The magnets 7 prevent the filling plate, in the fitted state and before the cutter head is fixed in place, from tipping forward from the cutter head disk. The filling plate may also be changed in its radial position by the eccentric retaining bolts 4. In the same manner as the knives 8, the filling plate 9 also interacts with the sealing edge 13, so that no cutting material passes between the filling plate 9 and the cutter head disk where it is responsible for insufficient hygiene or corrosion.

Figure 7:
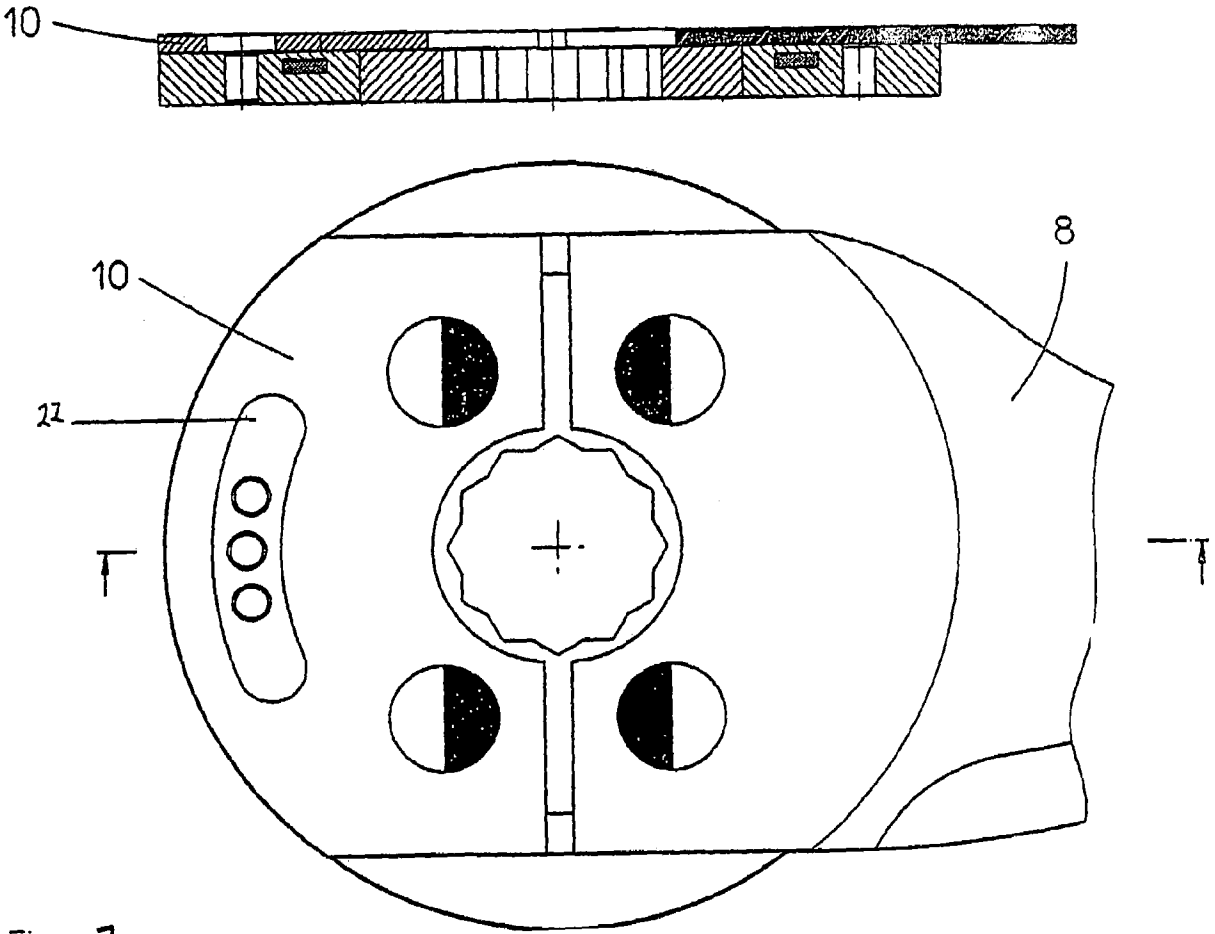
FIG. 7 shows a further embodiment of the system according to the invention with a filling plate.

FIG. 7 shows a further embodiment of the system according to the invention with a filling plate 10. In the present case, the filling plate has a recess 22 which serves to compensate for a dynamic unbalance. The person skilled in the art recognizes that the recess 22 can have any desired shape. Below the recesses 22, recesses 5 can be seen in the plastic envelope 3 of the cutter head disk 1.

Figure 8:
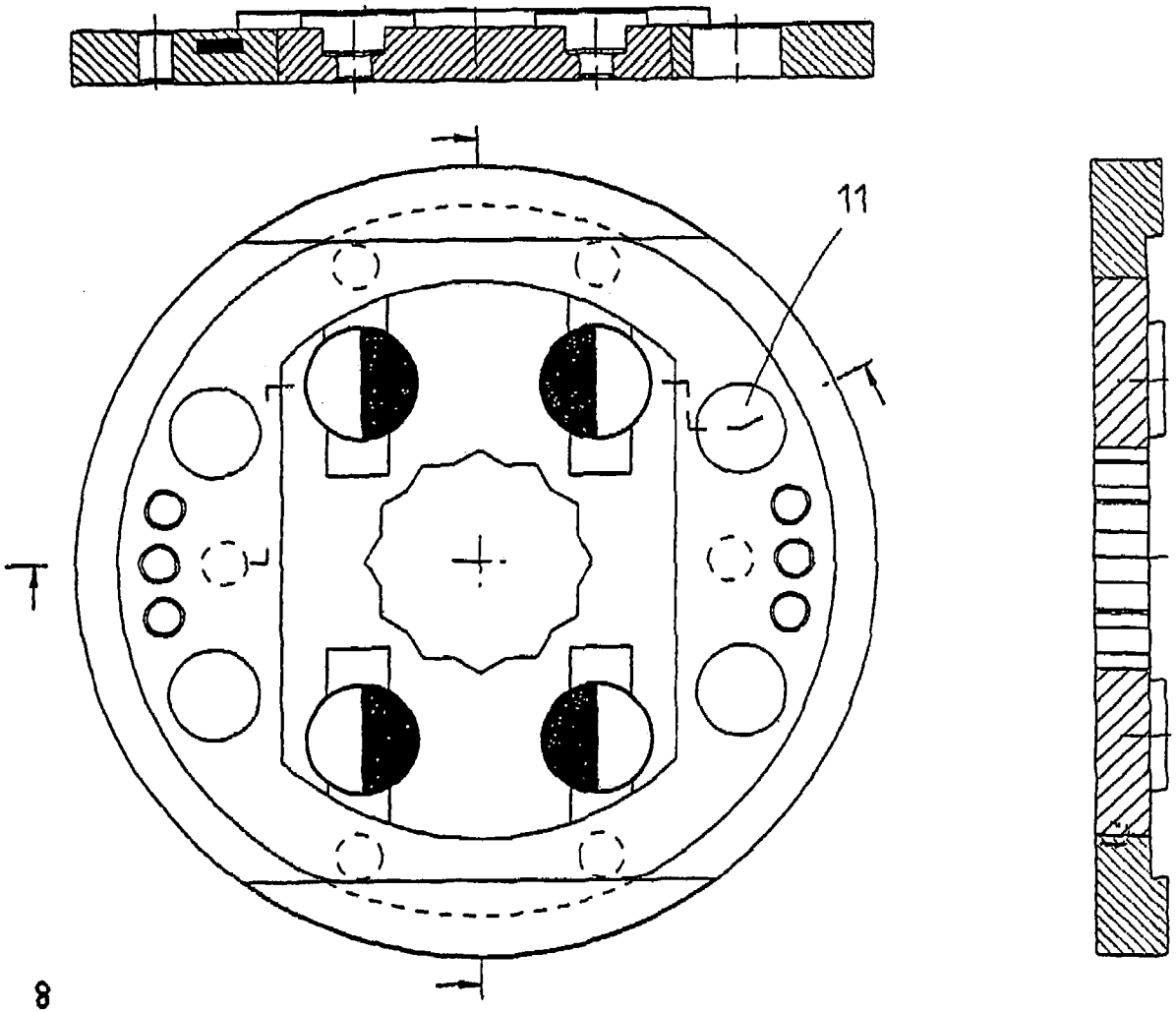
FIG. 8 shows a further embodiment of the cutter head disk according to the invention.
Figure 9:
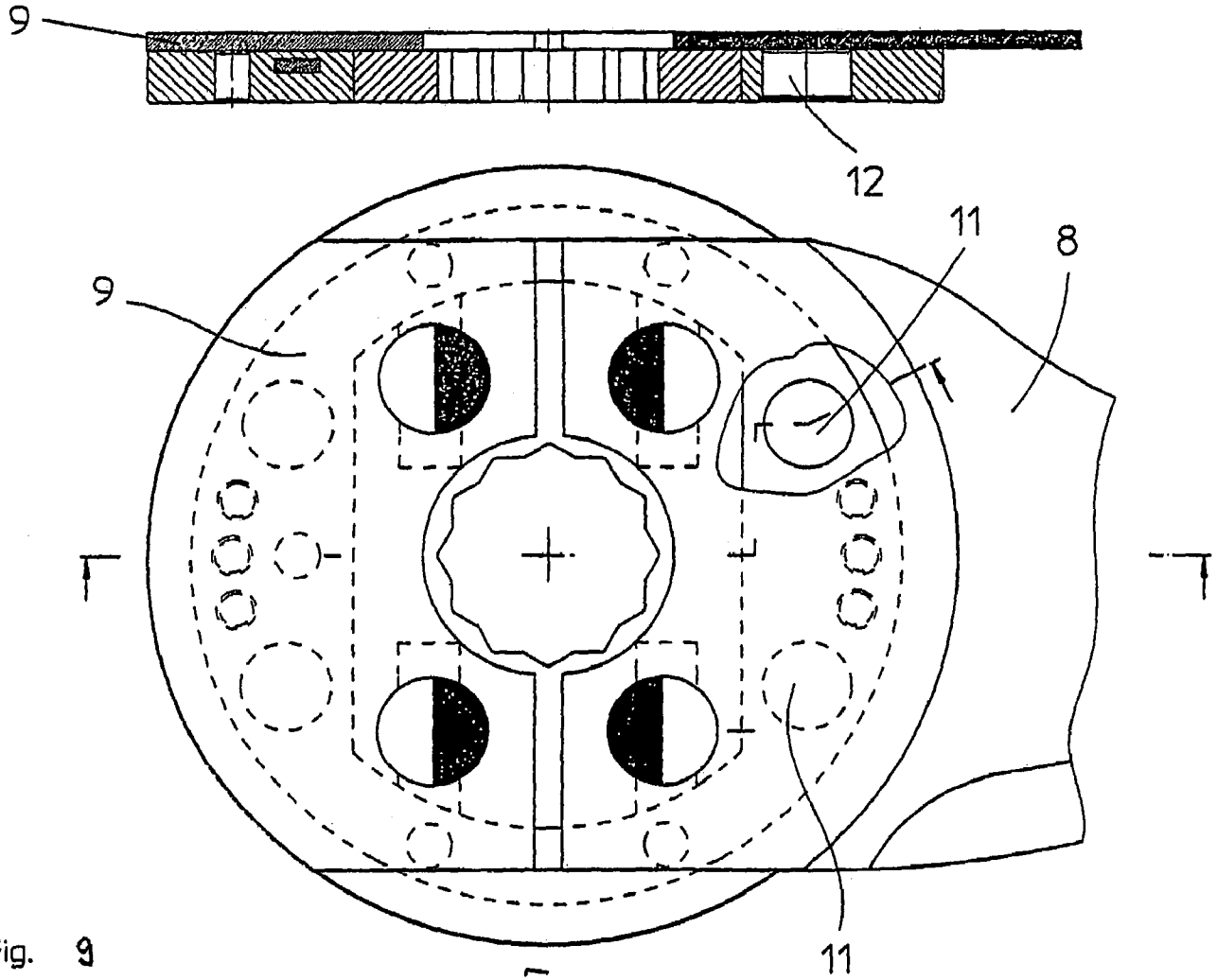
FIG. 9 shows a further embodiment of the system according to the invention with a filling plate.

FIG. 8 shows a further refinement of the cutter head disk according to the invention which essentially corresponds to the cutter head disk according to FIG. 1 but the present cutter head disk has recesses 11. These recesses can likewise be used to compensate for dynamic unbalances. Furthermore, these recesses, as illustrated in FIG. 9, can be filled with weights 12 in order even better to be able to compensate for dynamic unbalances.

Figure 10:
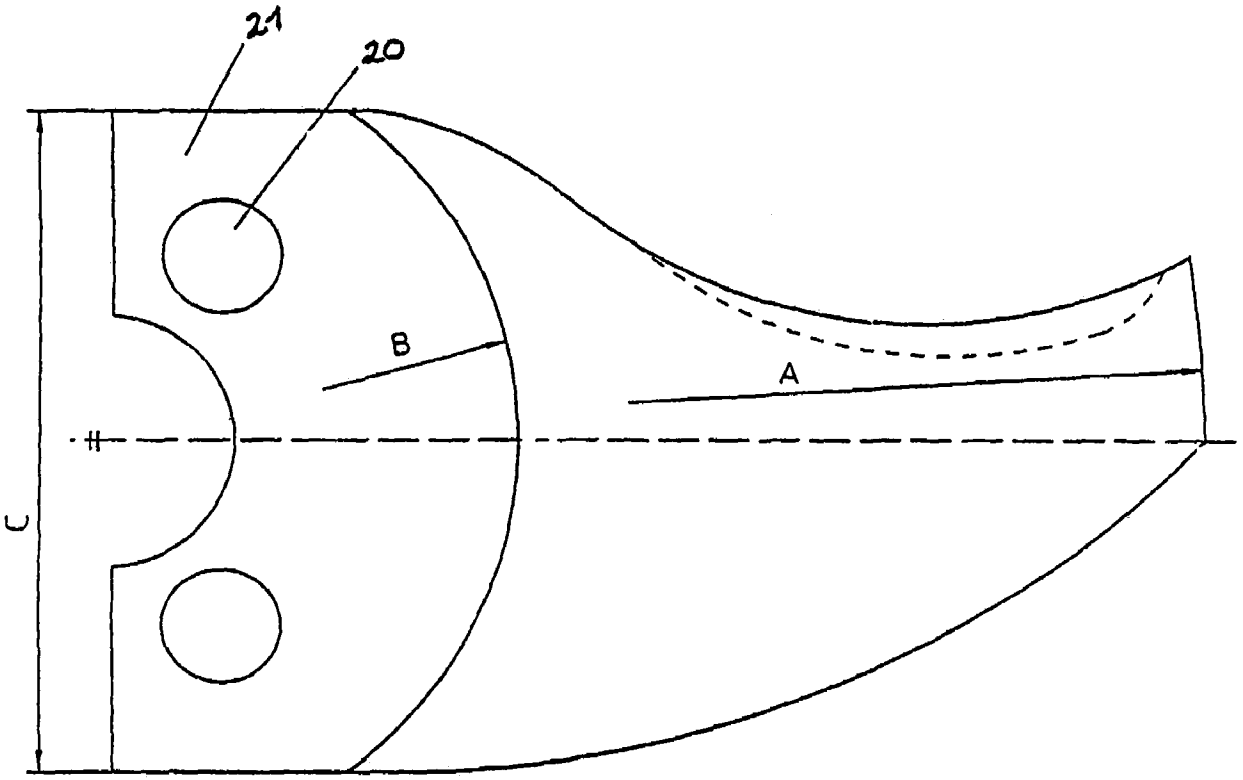
FIG. 10 shows a knife which can be mounted on the cutter head disk according to the invention.

FIG. 10 shows a knife which can be combined, for example, with the cutter head disk. The knife has in its base 21 with a possible shape of the recesses 20 which can be placed onto the eccentric retaining bolts. Furthermore, the ratio of the clamping radius B to the knife radius A in the present case is 0.35 and the ratio of the knife radius A to the receiving width C is 1.65. This knife can absorb very high axial loads without the flow of material into the plane of the paper being obstructed by the cutter head disk.

LIST OF REFERENCE NUMBERS

1 Cutter head disk with metallic core and plastic envelope
2 Cutter head disk with 12-edged receptacle for the drive shaft and eccentric retaining bolts for the fastening of the knives
3 Plastic envelope for the installation and clamping of the knives
4 Eccentric retaining bolts for the knives
5 Receiving hole for counterbalancing the knives
6 Compensating weight
7 Permanent magnet
8 Knife
9 Filling plate
10 Filling plate with cutout
11 Receiving bore for compensating weight
12 Compensating weight with knife construction on two levels
13 Sealing edge
14 Fastening screw
18 Recess
19 Shoulder
22 Cutout

The invention claimed is:

1. A cutter head disk for a meat cutter, on which at least one knife is mounted comprising at least one knife that cuts meat, the at least one knife having at least one recess, a metallic core for accommodating a drive shaft, the metallic core having at least one recess aligned with at least one recess of the at least one knife that cuts meat; a plastic envelope that surrounds the metallic core so that the metallic core is connected in a frictional manner, an interlocking manner, or a combination of both with the plastic envelope; and at least one eccentric retaining bolt that inserts into the at least one recess of each of the at least one knife and the metallic core to mount the at least one knife to the metallic core, wherein positioning of the eccentric retaining bolt between at least two rotational positions adjusts the position of the knife in at least two different radial positions on the cutter head disk.

2. The cutter head disk of claim 1, wherein the metallic core has a plurality of recesses for receiving in each case at least one eccentric retaining bolt for interferingly mounting through a corresponding aligned recess in the at least one knife.

3. The cutter head disk of claim 1, wherein the at least one knife includes a base having an outer edge and an outward facing surface through which the at least one knife recess is located, and a portion projecting radially away from the base and including an arcuate cutting edge, and the at least one knife is arranged in at least two different positions on the cutter head disk by means of the eccentric retaining bolt that penetrates into the base of the at least one knife.

4. The cutter head disk of claim 1, further comprising magnets embedded in the plastic envelope with which the at least one knife is fixed on the cutter head disk.

5. The cutter head disk of claim 1, further comprising at least one sealing edge.

6. The cutter head disk of claim 5, wherein the at least one sealing edge is a raised circular ring or section.

7. The cutter head disk of claim 1, further comprising a plurality of recesses.

8. The cutter head disk of claim 7, further comprising a plurality of weights that are fitted into the plurality of recesses.

9. The cutter head disk of claim 1, further comprising a plurality of shoulders a height of which is the same as or smaller than a thickness of a base of the at least one knife and a distance between which corresponds to a width of the base of the at least one knife.

10. The system of claim 1 wherein at least one eccentric retaining bolt includes a base and an enlarged head that is arranged eccentrically on the bolt base so that a bottom surface of the enlarged head engages the outer surface of the knife.

11. A system comprising a cutter head disk having a metallic core for accommodating a drive shaft; two knives that cut meat which in each case have two holes; wherein the metallic core is surrounded with a plastic envelope so that the metallic core is connected in a frictional manner, an interlocking manner, or a combination of both with the plastic envelope; and eccentric retaining bolts that connect two knives to the cutter head disk by the bases being introduced into the holes and fastening within recesses of the cutter head, wherein the eccentric retaining bolts each include a base and an enlarged head that is arranged eccentrically on the bolt base so that a bottom surface of the enlarged head engages the knife.

12. The system of claim 11, wherein the two knives, the filling plates, or both are reversibly fastened to the cutter head disk with magnets.

13. The system of claim 11, wherein a ratio of a clamping radius B to a knife radius A is 0.3-0.4.

14. The system of claim 11, a ratio of a knife radius A to a receiving width C is 1.4-2.0.

15. A system comprising a cutter head disk having a metallic core for accommodating a drive shaft; a knife that cuts meat and includes two holes; and a filling plate; wherein the metallic core (i) includes recesses that are laterally elongated in the outer plane of the core, and (ii) is surrounded with and connected to a plastic envelope; and at least one eccentric retaining bolt that includes a base and an enlarged head that is arranged eccentrically on the base so that a bottom surface of the enlarged head engages an outer surface of the knife.

16. The system of claim 15, wherein the filling plate has recesses.

17. A system comprising at least one cutter head disk on which at least one knife is mounted, the at least one cutter head disk being arranged on a drive shaft, wherein the cutter head includes a metallic core for accommodating the drive shaft, the metallic core being surrounded with a plastic envelope so that the metallic core is connected in a frictional manner, an interlocking manner, or a combination of both with the plastic envelope and wherein the cutter head further includes a plurality of shoulders, a height of which is the same as or smaller than a thickness of a base of the at least one knife and a distance between which corresponds to a width of the base of the at least one knife.

18. The system of claim 17, wherein a dynamic unbalance of the at least one cutter head disk is compensated for in a plane of the at least one knife.

19. The system of claim 17, wherein the at least one cutter head disk is or is not balanced.

20. The system of claim 17, the at least one knife includes a plurality of knives that are all of equal length.

21. The system of claim 17, wherein the at least one cutter head disk is closed to the outside and is smooth apart from the protruding at least one knife.

* * * * *